US007980311B2

(12) United States Patent
Dowling et al.

(10) Patent No.: US 7,980,311 B2
(45) Date of Patent: Jul. 19, 2011

(54) DEVICES, SYSTEMS AND METHODS FOR EQUALIZING PRESSURE IN A GAS WELL

(75) Inventors: Michael A. Dowling, Houston, TX (US); Jason Kamphaus, Missouri City, TX (US); Harryson Sukianto, Missouri City, TX (US); Alain P. Dorel, Houston, TX (US); Joseph Varkey, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 152 days.

(21) Appl. No.: 12/388,211

(22) Filed: Feb. 18, 2009

(65) Prior Publication Data

US 2010/0206568 A1 Aug. 19, 2010

(51) Int. Cl.
*E21B 31/00* (2006.01)

(52) U.S. Cl. ..... 166/301; 166/334.1

(58) Field of Classification Search ..... 166/301, 166/98, 99, 334.1

See application file for complete search history.

(56) References Cited

U.S. PATENT DOCUMENTS

| | | | | |
|---|---|---|---|---|
| 2,708,411 | A | 5/1955 | Richardson | |
| 2,834,300 | A | 5/1955 | Brock | |
| 2,941,629 | A | 6/1960 | Rohacs | |
| 3,183,972 | A | 5/1965 | Fredd | |
| 3,589,838 | A | 6/1971 | Tuzson | |
| 3,912,009 | A | 10/1975 | Davis, Jr. | |
| 4,031,957 | A * | 6/1977 | Sanford | 166/264 |
| 4,043,390 | A | 8/1977 | Glotin | |
| 4,164,977 | A * | 8/1979 | Arendt et al. | 166/125 |
| 4,184,515 | A | 1/1980 | Streich et al. | |
| 4,295,528 | A * | 10/1981 | Carmody | 166/382 |
| 4,317,485 | A | 3/1982 | Ross | |
| 4,368,911 | A * | 1/1983 | Pringle | 294/86.15 |
| 4,598,630 | A | 7/1986 | Kao | |
| 4,688,999 | A | 8/1987 | Ames et al. | |
| 4,767,145 | A * | 8/1988 | Bullard | 294/86.18 |
| 4,928,761 | A * | 5/1990 | Gazda et al. | 166/123 |
| 5,007,479 | A * | 4/1991 | Pleasants et al. | 166/178 |
| 5,188,517 | A | 2/1993 | Koster | |
| 5,197,773 | A * | 3/1993 | Vick, Jr. | 294/86.18 |

(Continued)

FOREIGN PATENT DOCUMENTS

GB 2099043 A 12/1982

(Continued)

*Primary Examiner* — Kenneth Thompson
*Assistant Examiner* — Catherine Loikith
(74) *Attorney, Agent, or Firm* — Andrus, Sceales, Starke & Sawall, LLP; Kevin B. McGoff; Jim Patterson

(57) ABSTRACT

Devices, systems and methods for equalizing pressure in a gas well are provided. A jar device is coupled to a pump deployed in a gas well between areas of low pressure and high pressure. The jar device includes a mandrel and a no-go sleeve. A jarring tool is operated to transfer an axial force onto the jar device that is large enough to shear a shearable connection between the mandrel and no-go sleeve and thereby cause the mandrel to slide from a first position to a second position with respect to the no-go sleeve. A seal that seals between the no-go sleeve and mandrel when the mandrel is located in the first position is unsealed as a result of the movement of the mandrel and thereby fluid communication is allowed between the area of high pressure and low pressure. This allows for easier retrieval of the pump.

23 Claims, 2 Drawing Sheets

U.S. PATENT DOCUMENTS 5,203,172 A 4/1993 Simpson et al.
5,229,017 A 7/1993 Nimerick et al.
5,577,890 A 11/1996 Nielsen et al.
5,778,978 A 7/1998 Crow
5,871,051 A 2/1999 Mann
5,961,841 A 10/1999 Bowers
6,000,468 A 12/1999 Pringle
6,017,198 A 1/2000 Traylor et al.
6,044,909 A 4/2000 Gano
6,069,118 A 5/2000 Hinkel et al.
6,089,322 A 7/2000 Kelley et al.
6,140,277 A 10/2000 Tibbles et al.
6,140,817 A 10/2000 Flaum et al.
6,152,219 A * 11/2000 Vick et al. ..... 166/117
6,196,309 B1 3/2001 Estilette, Sr.
6,508,310 B1 1/2003 Mioduszewski et al.
6,569,814 B1 5/2003 Brady et al.
6,638,896 B1 10/2003 Tibbles et al.
6,660,693 B2 12/2003 Miller et al.
6,720,290 B2 4/2004 England et al.
6,837,309 B2 1/2005 Boney et al.
6,854,515 B2 2/2005 Matthews et al.
6,915,854 B2 7/2005 England et al.
6,964,299 B2 11/2005 Scarsdale
7,005,765 B1 2/2006 Schulz et al.
7,124,819 B2 10/2006 Ciglenec et al.
7,299,872 B2 * 11/2007 Darnell ..... 166/301
7,380,608 B2 6/2008 Geier
7,726,404 B2 6/2010 Kubala et al.
2004/0060705 A1 4/2004 Kelley
2004/0084178 A1 5/2004 Reid
2006/0083645 A1 4/2006 Simmons
2007/0023191 A1 2/2007 Dreggevik
2007/0110597 A1 5/2007 Traylor et al.
2007/0227732 A1 10/2007 Miller et al.
2007/0251704 A1 11/2007 Reimert et al.
2009/0217992 A1 9/2009 Wilson
2010/0096129 A1 4/2010 Hinkel et al.
2010/0206544 A1 8/2010 Dowling et al.
2010/0206549 A1 8/2010 Dowling et al.
2010/0206568 A1 8/2010 Dowling et al.
2010/0209265 A1 8/2010 Dowling et al.
2010/0211226 A1 8/2010 Dowling et al.

FOREIGN PATENT DOCUMENTS

GB 2339914 A 2/2000
GB 2436576 A 10/2007
GB 2457784 A 9/2009
WO 2010096303 A1 8/2010
WO 2010096431 A1 8/2010
WO 2010096481 A1 8/2010

* cited by examiner

DEVICES, SYSTEMS AND METHODS FOR EQUALIZING PRESSURE IN A GAS WELL

FIELD

The present application relates generally to gas well dewatering systems. More particularly, the present application relates to equalization of pressure in a gas well to allow for easier retrieval of a dewatering pump.

BACKGROUND

Hydrocarbons and other fluids are often contained within subterranean formations at elevated pressures. Wells drilled into these formations allow the elevated pressure within the formation to force the fluids to the surface. However, in low pressure formations, or when the formation pressure has diminished, the formation pressure may be insufficient to force the fluids to the surface. In these cases, a positive displacement pump, such as a piston pump, can be installed to provide the required pressure to produce the fluids.

The function of pumping systems in gas wells is to produce liquid, generally water, that enters the wellbore naturally with the gas. This is typically necessary only on low-flow rate gas wells. In high-flow rate gas wells, the velocity of the gas is usually sufficient that it carries the water to the surface. In low-flow rate wells, the water accumulates in the wellbore and restricts the flow of gas. By pumping out the water, the pump allows the well to flow at a higher gas rate, and this additional produced gas, which eventually is related to additional revenue, pays for the pumping unit.

Operation of the pumping unit can create an area of low pressure beneath the pump compared to high pressure on top of the pump. The differential pressure can become great enough so as to prevent retrieval of the pumping unit by normal means. For example, the differential pressure can result in a pulling force requirement greater than the axial strength of a cable supporting the unit in the well. Pulling up on the cable will thus cause either the cable or a separate shearing mechanism to shear, thus leaving the pumping unit without a connection uphole. For this purpose, the pumping unit can include a fishing neck profile for retrieval using a separate fishing tool. However, without a means for equalizing the differential pressure, retrieval with the fishing tool can also be difficult or impossible.

SUMMARY

The present disclosure recognizes that it is desirable to provide devices, systems, and methods for equalizing pressure in a gas well to allow for easier retrieval of a dewatering pump deployed in the well between an area of low pressure and high pressure. It is recognized as desirable to provide such devices and systems that are durable and yet relatively inexpensive to manufacture, operate and repair.

Devices, systems and methods for equalizing pressure in a gas well are provided. In one example, a jar device is coupled to a pump deployed in a gas well between areas of low pressure and high pressure. The jar device includes a mandrel and a no-go sleeve. A jarring tool is operated to transfer an axial force onto the jar device that is large enough to shear a shearable connection between the mandrel and no-go sleeve and thereby cause the mandrel to slide from a first position to a second position with respect to the no-go sleeve. A seal that seals between the no-go sleeve and mandrel when the mandrel is located in the first position is unsealed as a result of the movement of the mandrel and fluid communication is thereby permitted between the areas of high pressure and low pressure. This allows for easier retrieval of the pump.

BRIEF DESCRIPTION OF THE DRAWINGS

The best mode is described hereinbelow with reference to the following drawing figures.

DETAILED DESCRIPTION OF THE DRAWINGS

In the following description, certain terms have been used for brevity, clearness, and understanding. No unnecessary limitations are to be implied therefrom beyond the requirement of the prior art because such terms are used for descriptive purposes only and are intended to be broadly construed. The different devices, systems and method steps described herein may be used alone or in combination with other devices, systems and method steps. It is to be expected that various equivalents, alternatives, and modifications are possible within the scope of the appended claims.

Figure 1:
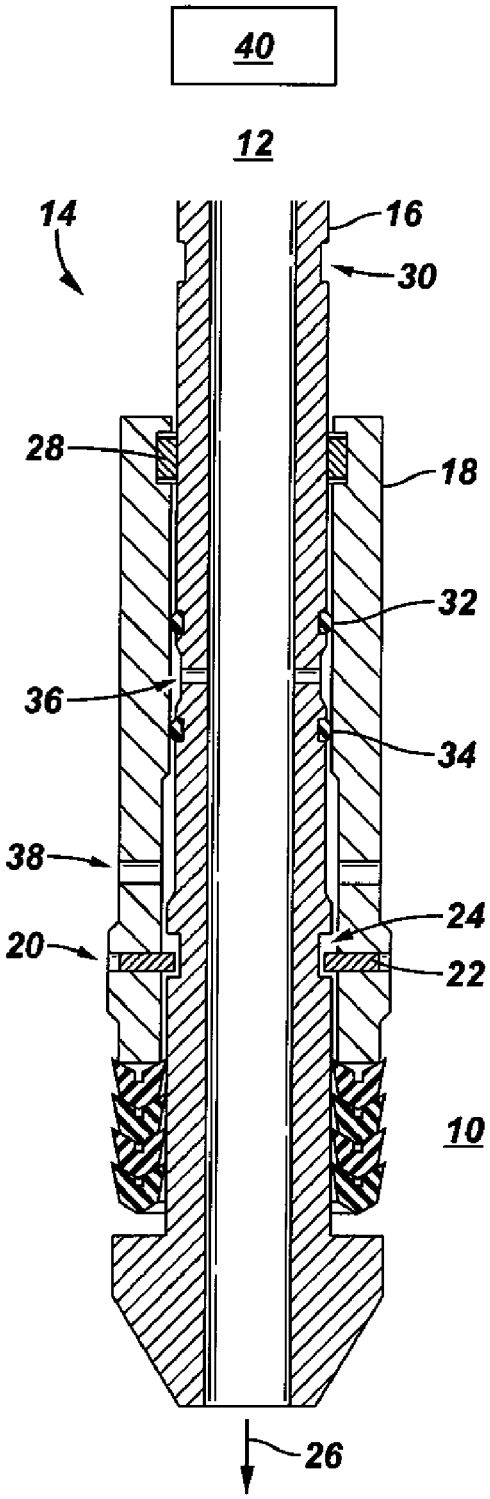
FIG. 1 depicts a jar device having a mandrel located in a first position with respect to a no-go sleeve.
Figure 2:
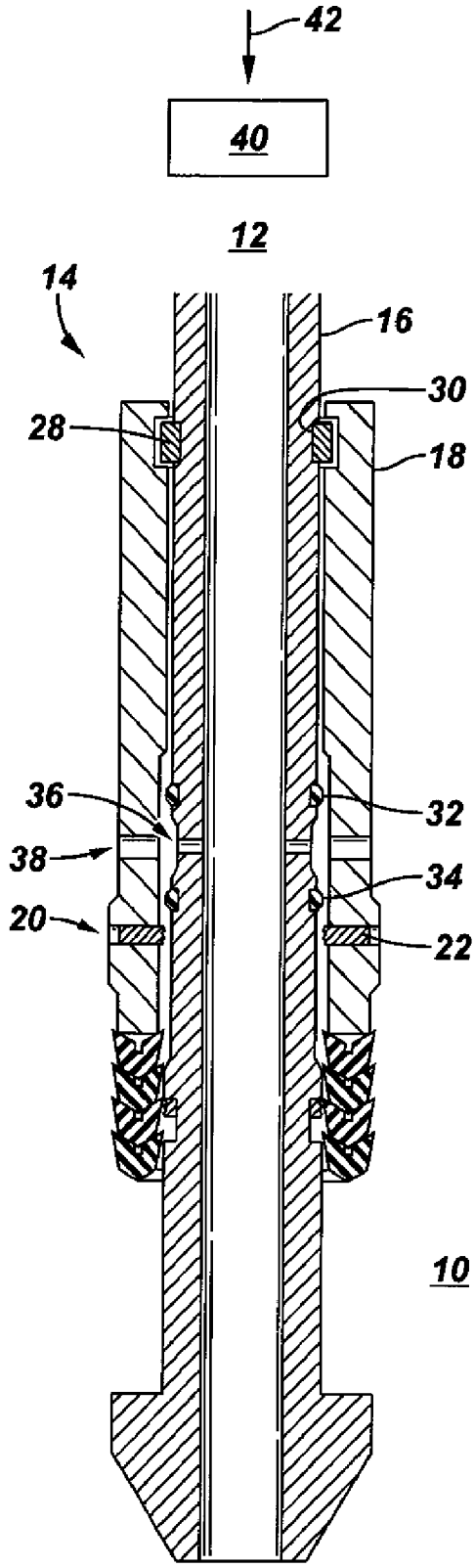
FIG. 2 is the jar device of FIG. 1 wherein the mandrel is located in a second position with respect to the no-go sleeve.

FIGS. 1 and 2 depict a device for facilitating retrieval of a pump deployed in a gas well between an area 10 of low pressure and an area 12 of high pressure. Specifically, a jar device 14 includes a mandrel 16 and a no-go sleeve 18. The mandrel 16 and no-go sleeve 18 are connected by a shearable connection 20, which in the example shown is made by shear pins 22 extending inwardly from the inner diameter of the no-go sleeve 18 and engaged in a channel 24 on the outer surface of the mandrel 16. Shearing of the shear pins 22 allows the mandrel 16 to slide in a downhole direction (arrow 26) along the inner diameter of the stationary no-go sleeve 18.

A locking ring 28 extends inwardly from the inner diameter of the no-go sleeve 18 and is configured to engage and lock with a locking groove 30 on the outer surface of the mandrel 16 to retain the mandrel 16 in the second position (FIG. 2). Upper and lower O-ring seals 32, 34 seal between the inner surface of the no-go sleeve 18 and the outer surface of the mandrel 16. Equalization holes 36 are formed through the mandrel 16 between the upper and lower O-rings 32, 34. Equalization holes 38 are formed in the no-go sleeve 18. The equalization holes 36 are located uphole from the equalization holes 38 when the mandrel 16 is in the first position (FIG. 1) and the equalization holes 36 and 38 are substantially aligned when the mandrel 16 is located in the second position (FIG. 2). In the first position, the O-rings 32, 34 seal between the mandrel 16 and no-go sleeve 18, thereby preventing fluid communication between the areas 10, 12 of low pressure and high pressure. In the second position (FIG. 2), fluid communication is allowed between the areas 10, 12 of low pressure and high pressure via the respective aligned equalization holes 36, 38.

In use, the device 14 is coupled to a pump (not shown) deployed in a gas well between the areas 10, 12 of low pressure and high pressure. The areas 10, 12 of low pressure and high pressure are created by operation of the pump. When retrieval of the pump by manual or other means is required, the differential pressure between the areas 10, 12 works against the retrieval action, thus making it difficult to remove the pump from the well. The system shown in FIGS. 1 and 2 alleviates this problem by allowing for selective communication between the areas 10, 12. While in the first position (FIG. 1), the jar device 14 prevents fluid communication between the areas 10, 12 and thus allows for operation of the attached pump. When retrieval is desired, a jarring tool, which can for example be spang jars and weight (shown schematically at 40) is attached to the pump. The operator elevates the weight and drops it to create a downward force shown at arrow 42 (FIG. 2). When jarred downward, the no-go sleeve 18 remains stationary while the shearable connection 20 is sheared and the mandrel 16 is allowed to slide downwardly in the direction of arrow 26. This downward motion aligns the equalization holes 36, 38 and establishes hydraulic communication above and below the device 14. Pressure equalization is thus achieved, which facilitates easier removal of the pump and associated jar device 14 from the well via for example a fishing neck and tool.

Optionally, the lock ring 28 engages with the locking groove 30 as the mandrel 16 is moved into the second position (FIG. 2). This effectively locks the mandrel 16 in the second position, which further facilitates a retrieval force on the mandrel 16 to remove the device 14 from the well.

Figure 3:
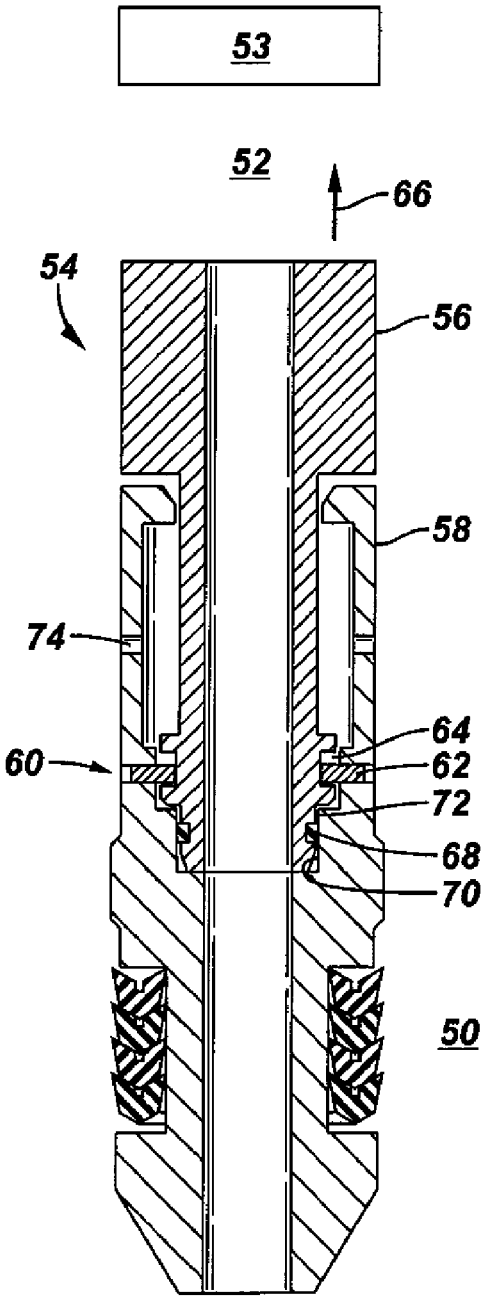
FIG. 3 is another example of a jar device having a mandrel located in a first position with respect to a no-go sleeve.
Figure 4:
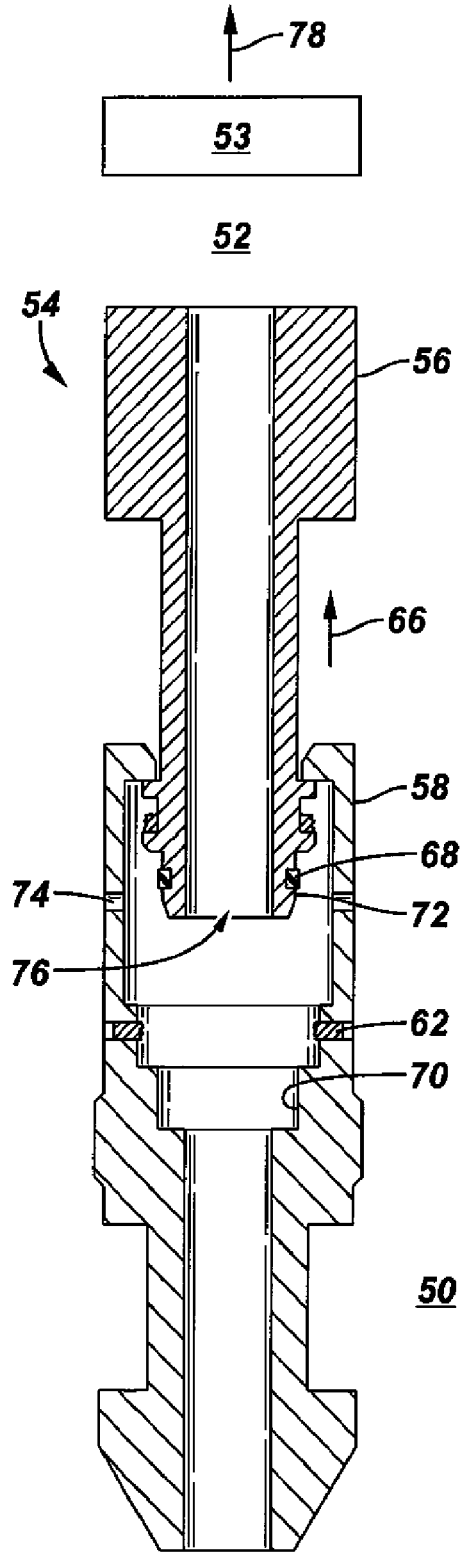
FIG. 4 is the jar device shown in FIG. 3 wherein the mandrel is located in a second position with respect to the no-go sleeve.

FIGS. 3 and 4 depict another system for allowing retrieval of a dewatering pump deployed in a gas well between an area of low pressure 50 and an area of high pressure 52. A jar device 54 includes an inner mandrel 56 and an outer no-go sleeve 58. The mandrel 56 and no-go sleeve 58 are connected by a shearable connection 60 formed by shear pins 62 extending inwardly from the inner surface of the no-go sleeve 58 and engaging with a shear channel 64 on the outer surface of the mandrel 56. The mandrel 56 is configured to slide axially from a first position (FIG. 3) to a second position (FIG. 4) in an uphole direction shown by arrow 66.

An O-ring 68 forms a seal between an inner surface 70 of the no-go sleeve 58 and the outer surface 72 of the mandrel 56 when the mandrel 56 is located in the first position (FIG. 3). Equalization holes 74 are formed through the mandrel 76. The holes 74 are located uphole of the seal 68 when the mandrel 56 is in the first position (FIG. 3). When the mandrel 56 is in the second position (FIG. 4), the equalization holes 74 are placed in fluid communication with an open end 76 of the mandrel 56, thus allowing fluid communication between the areas of low pressure 50 and high pressure 52.

In use, the jar device 54 is coupled to a dewatering pump deployed in a gas well between the areas 50, 52. A jarring tool 53 such as spang jars and weight is operated to transfer an axial force in the direction of arrow 78 large enough to shear the shearable connection 60 and cause the mandrel 56 to move uphole in the direction of arrow 66 into the second position shown in FIG. 4. Movement of the mandrel 56 releases the seal 68 between the surfaces 70, 72 and allows fluid communication through the equalization holes 74, open end 76, and thus between the areas 50, 52 thereby equalizing pressure above and below the pump. This allows for easier retrieval of the pump from the well.

What is claimed is:

1. A device connected to a pump deployed in a gas well between an area of low pressure and an area of high pressure, the device comprising:

a jar device, the jar device comprising a mandrel and a no-go sleeve, wherein the mandrel is attached to the no-go sleeve by a shearable connection, and wherein the mandrel is configured to slide axially from a first position to a second position with respect to the no-go sleeve when the shearable connection is sheared;

a seal that prevents fluid communication between the area of high pressure and the area of low pressure when the mandrel is located in the first position and that does not prevent fluid communication between the area of high pressure and the area of low pressure when the mandrel is located in the second position; and a jarring tool actuatable to apply an axial force onto the jar device that is large enough to shear the shearable connection and cause the mandrel to slide from the first position to the second position.

2. The device according to claim 1, wherein the first position is located uphole of the second position and the jarring tool jars down on the jar device.

3. The device according to claim 1, wherein the seal seals between the no-go sleeve and the mandrel in the first position and wherein the seal does not seal between the no-go sleeve and the mandrel in the second position.

4. The device according to claim 1, wherein the seal prevents fluid flow through apertures in the mandrel and no-go sleeve when the mandrel is located in the first position and wherein the seal does not prevent fluid flow through the apertures in the mandrel and no-go sleeve when the mandrel is located in the second position.

5. The device according to claim 1, comprising a locking device that locks the mandrel and no-go sleeve into the second position.

6. The device according to claim 5, wherein the locking device comprises a locking ring and corresponding locking groove.

7. The device according to claim 1, wherein the first position is located downhole of the second position and the jarring tool jars up on the jar device.

8. The device according to claim 7, wherein the seal prevents fluid flow through an aperture in the no-go sleeve when the mandrel is located in the first position and wherein the seal does not prevent fluid flow through the aperture in the no-go sleeve when the mandrel is located in the second position.

9. The device according to claim 7, wherein the no-go sleeve comprises a retrieval collet and the mandrel comprises a corresponding flange configured to engage with the retrieval collet when the mandrel slides into the second position.

10. The device according to claim 1, wherein the jarring tool comprises spang jars and weights.

11. A system for allowing retrieval of a pump from a gas well, the system comprising:

a retrievable pump deployed in a gas well so as to separate areas of low pressure and high pressure;

a jar device coupled to the pump and comprising a mandrel and a no-go sleeve, wherein the mandrel is attached to the no-go sleeve by a shearable connection, wherein shearing of the shearable connection allows the mandrel to slide axially from a first position to a second position with respect to the no-go sleeve;

a seal that prevents fluid communication between the areas of high pressure and low pressure when the mandrel is located in the first position, and that does not prevent fluid communication between the areas of high pressure and low pressure when the mandrel is located in the second position; and a jarring tool configured to transfer an axial force onto the jar device that is large enough to shear the shearable connection and cause the mandrel to slide from the first position to the second position.

12. The system according to claim 11, wherein the first position is located uphole of the second position and the jarring tool jars down on the jar device.

13. The system according to claim 11, wherein the seal seals between the no-go sleeve and mandrel in the first position and wherein the seal does not seal between the no-go sleeve and mandrel in the second position.

14. The system according to claim 11, wherein the seal prevents fluid flow through apertures in the mandrel and no-go sleeve when the mandrel is located in the first position and wherein the seal does not prevent fluid flow through the apertures in the mandrel and no-go sleeve when the mandrel is located in the second position.

15. The system according to claim 11, comprising a locking device that locks the mandrel and no-go sleeve into the second position.

16. The system according to claim 15, wherein the locking device comprises a locking ring and corresponding locking groove.

17. The system according to claim 11, wherein the first position is located downhole of the second position and the jarring tool jars up on the jar device.

18. The system according to claim 17, wherein the seal prevents fluid flow through an aperture in the no-go sleeve when the mandrel is located in the first position and wherein the seal does not prevent fluid flow through the aperture in the no-go sleeve when the mandrel is in the second position.

19. The system according to claim 17, wherein the no-go sleeve comprises a retrieval collet and the mandrel comprises a corresponding flange configured to engage with the retrieval collet when the mandrel slides into the second position.

20. The system according to claim 11, wherein the jarring tool comprises spang jars and weights.

21. A method of retrieving a pump deployed in a gas well between an area of low pressure and an area of high pressure, the method comprising the steps of:

providing a jar device coupled to the pump and comprising a mandrel and a no-go sleeve;

operating a jarring tool to transfer an axial force onto the jar device that is large enough to shear a shearable connection between the mandrel and no-go sleeve and thereby cause the mandrel to slide from a first position to a second position with respect to the no-go sleeve;

wherein a seal that seals between the no-go sleeve and mandrel when the mandrel is located in the first position is unsealed by operation of the jarring tool to thereby allow fluid communication between the area of high pressure and the area of low pressure and allow for easier retrieval of the pump.

22. The method of claim 21, comprising the step of jarring down on the jar device to shear the shearable connection.

23. The method of claim 21, comprising the step of jarring up on the jar device to shear the shearable connection.

* * * * *